US006283726B1

(12) United States Patent
Fackelmann et al.

(10) Patent No.: US 6,283,726 B1
(45) Date of Patent: Sep. 4, 2001

(54) RADIAL BLOWER, PARTICULARLY FOR HEATING AND AIR CONDITIONING SYSTEMS IN AUTOMOBILES

(75) Inventors: Walter Fackelmann; Heinrich Hillrichs, both of Oldenburg (DE)

(73) Assignee: TEMIC Automotive Electric Motors GmbH, Oldenburg (DE)

( * ) Notice: Subject to any disclaimer, the term of this patent is extended or adjusted under 35 U.S.C. 154(b) by 0 days.

(21) Appl. No.: 09/518,897

(22) Filed: Mar. 6, 2000

(30) Foreign Application Priority Data

Mar. 4, 1999 (DE) ..... 199 09 507

(51) Int. Cl.[7] ..... F04B 39/02

(52) U.S. Cl. ..... 417/366; 417/368; 417/370; 415/58.4

(58) Field of Search ..... 417/366, 368, 417/370; 415/52.1, 58.2, 58.4, 175, 176

(56) References Cited

U.S. PATENT DOCUMENTS 3,081,975 * 3/1963 Sproule et al. ..... 415/58.4
3,280,750 * 10/1966 White ..... 417/370
4,470,753 9/1984 Witzel .
5,743,721 * 4/1998 Graham et al. ..... 415/58.4

FOREIGN PATENT DOCUMENTS 2939385 4/1981 (DE) .
3427565 2/1986 (DE) .
19547674 6/1997 (DE) .

* cited by examiner

*Primary Examiner*—Charles G. Freay
(74) *Attorney, Agent, or Firm*—W. F. Fasse; W. G. Fasse

(57) ABSTRACT

A radial blower, particularly for heating and air-conditioning systems for automobiles, has a spiral blower housing that is provided with an air intake (5) in a housing lateral wall and with an air outlet out of the spiral housing. A blower drive motor for a fan wheel is mounted to the housing with the fan wheel positioned in the spiral housing to face the air intake (5). The fan wheel has a fan ring with fan blades and a hub. The fan ring and the hub are connected to each other by a shell shaped vaulted or dished fan disk, which at least partly surrounds the drive motor. Fan disk openings (43) permit at least a portion of cooling air flowing through the drive motor to be discharged through the disk openings (43) into a blower air discharge chamber (23) in the spiral housing. The openings in the fan disk are formed to generate a negative pressure at these openings on a fan disk surface facing away from the drive motor whereby airflow through the motor is increased because the negative pressure draws more cooling air through the motor. The suction is further increased by streamlined hoods (61) covering part of the fan disk openings on the disk surface facing away from the motor. The increased airflow through the drive motor increases the service life of the blower and of the motor.

7 Claims, 3 Drawing Sheets

RADIAL BLOWER, PARTICULARLY FOR HEATING AND AIR CONDITIONING SYSTEMS IN AUTOMOBILES

PRIORITY CLAIM

This application is based on and claims the priority under 35 U.S.C. §119 of German Patent Application No. 199 09 507.8, filed on Mar. 4, 1999, the entire disclosure of which is incorporated herein by reference.

FIELD OF THE INVENTION

The invention relates to a radial blower, particularly for heating and air-conditioning systems in automobiles. Such blowers have a spirally shaped blower housing with air inlets in one housing sidewall and a blower motor mounted to the blower housing, so that a fan wheel driven by the motor faces the air inlets.

BACKGROUND INFORMATION

The space available in an automobile for installing a heating, venting and air cooling system is generally rather limited. Often, a centrifugal blower is used for circulating air, particularly to achieve a desired quiet operation. A space-saving construction of such a blower is achieved if the air is drawn directly into the blower at an intake positioned in a blower housing wall opposite the wall to or on which an electric blower motor is mounted. However, in such a construction it is difficult to adequately cool the blower motor itself.

German Patent Publication DE 195 47 674 A1 discloses a radial blower, particularly for heating and air-conditioning systems for automobiles. In the known blower, a fan wheel driven by an electric blower motor is encased in a spiral housing section. The housing has a suction air inlet opening into a suction chamber and an air outlet leading to the outside. A closed portion of the housing opposite the air inlets has a shell-shaped recess in which at least a portion of the electric blower motor is arranged. The other portion of the electric blower motor is arranged within a shell-shaped and vaulted carrier or fan disk that connects a hub of a fan wheel with its fan ring. The fan ring supported by the carrier or fan disk has first fixed blades (31) arranged at the radial outer run of the carrier or fan disk and extending axially and radially outwardly of the electric blower motor. Second fixed blades (41) are positioned on a smoothly formed, closed inner surface facing the motor for diverting a cooling air flow from a main air flow, into the spiral housing for cooling the electric blower motor. The known radial blower brought some improvement in the cooling of the blower motor, relative to the then known art. However, especially during extended operation, the components become too hot, which has a negative effect on the service life of the blower motor.

U.S. Pat. No. 4,470,753 (Witzel—September /1984), corresponding to German Patent Publication DE 2,939,385 discloses an improved cooling of the electric motor by a radial blower in a housing having an air intake opening on its front side and a drive motor for a fan wheel on its rear side. The fan wheel has a fan ring with fan blades on a hub. A shell-shaped curved fan disk connects the fan ring to the hub. The fan disk is provided with openings through which motor-cooling air is drawn into the intake side of the fan wheel, thereby achieving good cooling of the electric motor. However, there is room for improvement.

German Patent Publication DE 34 27 565 C2 also discloses a radial blower with a radial fan driven by an electric motor. A fan disk is provided with axially outwardly extending fan blades arranged on the radial outer area of the disk. The fan disk has openings through which the cooling air which has been warmed by the electric motor, is drawn to the intake or suction side of the fan wheel, mixed with the inflow air, and diverted into the spiral delivery chamber. This fan wheel, however, is less suitable for applications that require quiet operation because the openings in the fan disk allow "short-circuit" flow between the pressure side and the suction side and, thus, the blower tends to be noisy.

OF THE INVENTION

In view of the foregoing, it is the aim of the invention to achieve the following objects singly or in combination:

- to provide a radial blower, particularly for use in heating and air-conditioning systems in automobiles, that will adequately cool the electric blower motor, yet will run quietly;
- to avoid or overcome the disadvantages of the prior art, particularly to increase the operational life of vehicle heating and cooling systems, especially of the motor of such system;
- to improve the cooling air flow through the blower motor generally at all blower motor r.p.m.s, and particularly in a normal r.p.m. range where the fan does not run at high speed, to keep particularly the motor at a non-critical temperature range.

SUMMARY OF THE INVENTION

According to the invention there is provided a radial blower comprising a spiral housing, an air inlet in the spiral housing, a fan wheel in said spiral housing, a blower drive motor mounted for driving said fan wheel in said spiral housing. The fan wheel comprises a hub, fan blades forming a fan ring and a shell-shaped, vaulted fan disk connecting the fan ring to the hub. The fan disk comprises at least one fan disk opening. A hood is arranged on a fan disk surface facing away from said blower drive motor. The hood is so shaped and positioned that it covers at least a forward or leading portion of the fan disk opening relative to a direction of rotation of the fan wheel for generating a negative pressure on the fan disk surface facing away the blower motor when the fan wheel rotates, whereby airflow through the at least one fan disk opening and thus also through the blower motor is increased by suction caused by the negative pressure.

Preferably, the fan disk according to the invention has a plurality of partially-hooded openings which are so constructed that a forward or leading end of an opening relative to the direction of rotation of the fan wheel, is partly covered by the respective raised hood that is open at a trailing or rear end facing opposite to the direction of rotation of the fan wheel. As the fan wheel rotates, a negative pressure is generated by the plurality of hoods each covering at least partly a respective opening. The negative pressure occurs just behind the hood above the opening on the side of the fan disk facing away from the drive motor. This negative pressure or suction increases the airflow through the blower drive motor, thereby providing effective cooling of the motor and its components. The cooling air passing through the blower drive motor is pulled through the partially-hooded openings in the fan disk into the intake or suction chamber in the spiral housing of the blower wheel, mixed with the main airflow volume, and transported to the blower air discharge opening or openings. Increasing airflow through the motor reduces the temperature of the motor components to an uncritical temperature range whereby the service life of the drive motor and thus of the system is increased. The shape of the hoods also contributes to a quieter blower operation. Furthermore, because of its compact construction, the radial blower can be used advantageously in automobiles that have very little available space.

It is advantageous to construct the fan wheel or impeller with its hub, its fan ring with the fan blades, and the fan disk with its openings and hoods as a single component, preferably as an injection-molded part, preferably made of a plastic material.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
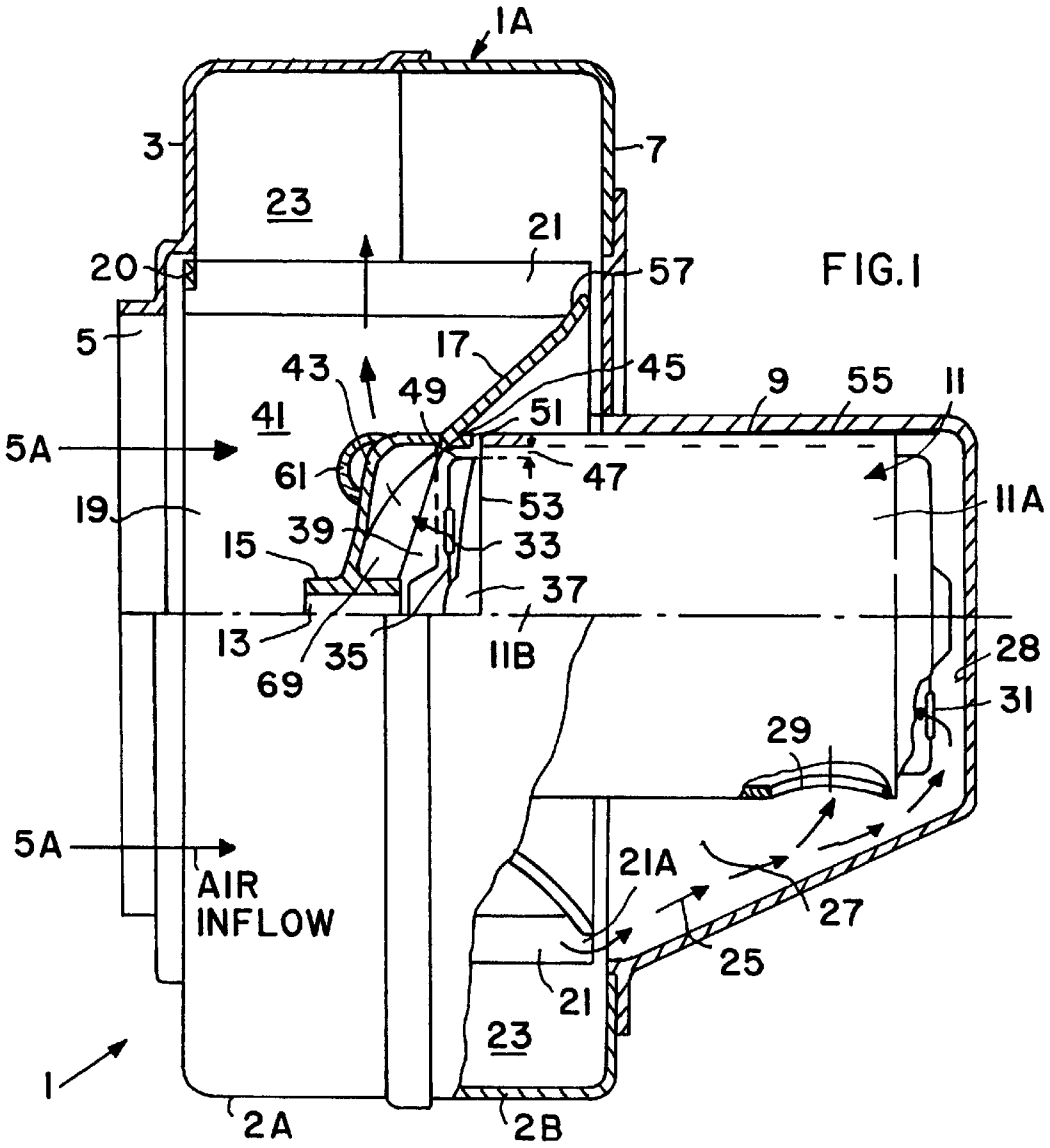
FIG. 1 shows a first embodiment of a radial blower, with cut-away views illustrating airflow arrows through a blower motor driving a fan disk having partly hooded air flow openings.

FIG. 1 shows a first embodiment of a radial blower 1, particularly for heating and air-conditioning systems in automobiles. The blower 1 has a spiral blower housing 1A which is preferably divided into two separable shell sections 2A and 2B for easy access. A front wall 3 of the blower housing shell section 2A has an air intake opening 5. Arrows 5A show the air inflow. A housing rear wall 7 has attached thereto a closed housing extension 9. A blower drive motor 11 is mounted in the blower housing so that a rear portion 11A of the blower drive motor 11 is enclosed in the extension 9. The drive motor 11 is for example an electric motor, but could be any other motor such as a hydraulic motor. For purposes of noise insulation, the drive motor 11 or rather its housing 55 is surrounded on all sides by an air gap except where the motor housing 55 is secured to the blower housing extension 9, for example by lands not shown.

Figure 2:
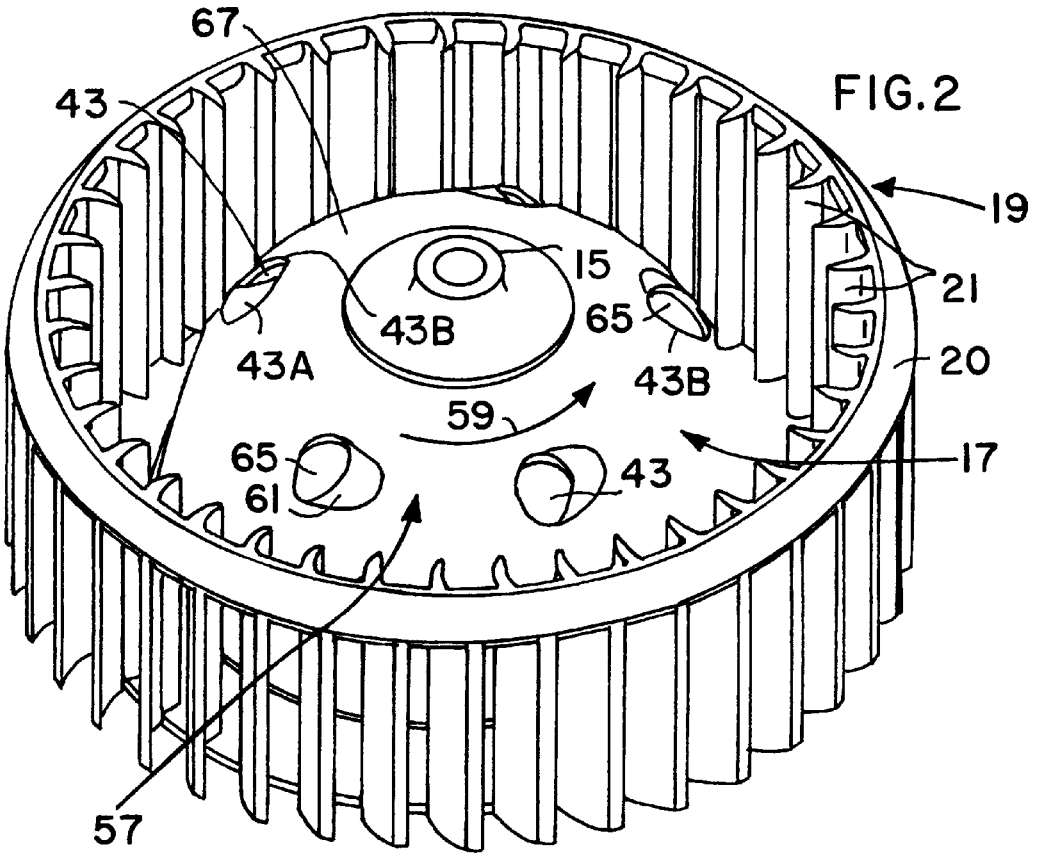
FIG. 2 shows the fan wheel of the radial blower with air guide hoods on the fan disk according to FIG. 1.

A fan wheel 19 having a vaulted or dished fan disk 17 is fastened by a hub 15 to a shaft end 13 of the drive motor 11. The fan disk 17 preferably surrounds with its dished shape a front portion 11B of the drive motor 11. A plurality of blower vanes 21 is distributed evenly around the fan wheel 19 at the outer circumference of the fan disk 17. The vanes are interconnected at least at one vane end preferably at both vane ends with each other to form a fan ring 20 as best seen in FIG. 2. The vanes 21 suck air through the air intake opening 5 of the blower housing 1A and drive the air into a spiral blower chamber 23 which guides the air into an air discharge opening not shown in FIG. 1, but seen at 74 in FIG. 3.

A small portion of the air that flows through the system is diverted through an outlet 21A as cooling air for the drive motor 11. The diverted air flows in the direction of arrows 25 through a motor-air supply channel 27 formed by the housing extension 9, into the drive motor 11. In this first embodiment, as shown in FIG. 1, the cooling air passes from the motor-air supply channel 27 through motor cooling air openings 29, 31 into the drive motor 11. Electric motors with open end shields do not require extra motor openings.

As the cooling air flows through the drive motor 11 it picks up waste heat from the drive motor 11 and exits from the internal space of the motor through motor air discharge openings 33 in an end cover 35 on the shaft-side end shield 37 of the drive motor 11. In electric motors with open end shields, the cooling air flows through the openings in the end shields. The cooling air then reaches a motor air discharge chamber 39 between the shaft-side end shield 37 with its cover 35 and the fan disk 17. The fan disk 17 has a plurality of fan disk openings 43 for passing air from the motor air discharge chamber 39 to an air intake side or chamber 41 of the fan wheel 19. As heated cooling air passes through the fan disk openings 43 into the intake side or chamber 41, it is mixed with the intake air and channeled off into the spiral discharge chamber 23 of the blower 1.

As shown in FIG. 1 and according to the invention, the air discharge chamber 23 is substantially sealed from the motor air discharge chamber 39 by the fan disk 17, except for the openings 43 and except for a narrow ring gap 47. The ring gap 47 has an axially extending portion and a radially extending portion. The ring gap 47 is surrounded on one side by a cylindrical ring 45 secured to the fan disk 17 and extending axially relative to a central motor axis. The axial portion of the ring gap 47 extends between the ring 45 and a radially outwardly facing surface 49 of the motor cover 35. The radial portion of the ring gap 47 extends between an endface 51 of the ring 45 arranged opposite an endface 53 of the motor housing 55. The term "narrow ring gap" as used herein means that both portions of the gap 47 are just wide enough to permit rotation of the fan disk 17 without interference with motor components facing axially.

The radial blower of the invention increases the flow of cooling air through the drive motor 11 by generating a negative pressure on an intake-facing side 57 of the fan disk 17 as the fan wheel 19 rotates. For this purpose according to the invention the above-mentioned fan disk openings 43 are each partly covered by a specially constructed hood 61 as will be described in more detail below.

FIG. 2 shows the fan wheel 19 with the hub 15, the fan ring 20 with the fan blades 21 and the fan disk 17 that connects the hub 15 with the fan ring 20. The fan disk openings 43 pass through a wall forming the dished or vaulted fan disk 17, which surrounds the front portion 11B of the drive motor 11. According to the invention, each of the fan disk openings 43 is covered at least partly by a streamlined hood 61. Each hood 61 slopes upwardly relative to the surrounding surface of the fan disk 17 from a closed leading end 61A of the hood 61 to an open trailing end 61B of the hood 61 as viewed in the direction 59 of rotation of the fan wheel 19. The leading hood end 61A covers a leading end 43A of the respective fan disk opening 43 thereby diverting an airflow from the motor air discharge chamber 39 toward the open trailing end 61B and into the intake side or chamber 41. The open trailing end 61B forms a hood opening 65 facing downstream or away from the leading end 43A as the fan wheel 19 rotates. This diverted airflow out of the hood opening 65 generates a negative pressure or suction near the hood opening 65 whereby the suction of at least a part of the cooling air through the drive motor 11 is improved and more cooling air passes through these hood openings 65. The motor cooling air is then led into the main air flow in the intake chamber 41 of the blower housing 1. Advantageously, the fan wheel 19 according to FIG. 2, is a single-piece injection-molded part, preferably made of a plastic material.

As shown in FIG. 1, internal vanes 69 extending from the hub 15 to the ends of the fan disk openings 43 are provided to ensure that sufficient cooling air is transported through the drive motor 11 even when the positive pressure in the spiral discharge chamber 23 is at its lowest, that is, even when the maximal amount of air is being delivered by the blower. These vanes 69 generate an additional feeding pressure exclusively for the motor cooling air and independently of the respective choking of the blower air.

Figure 3:
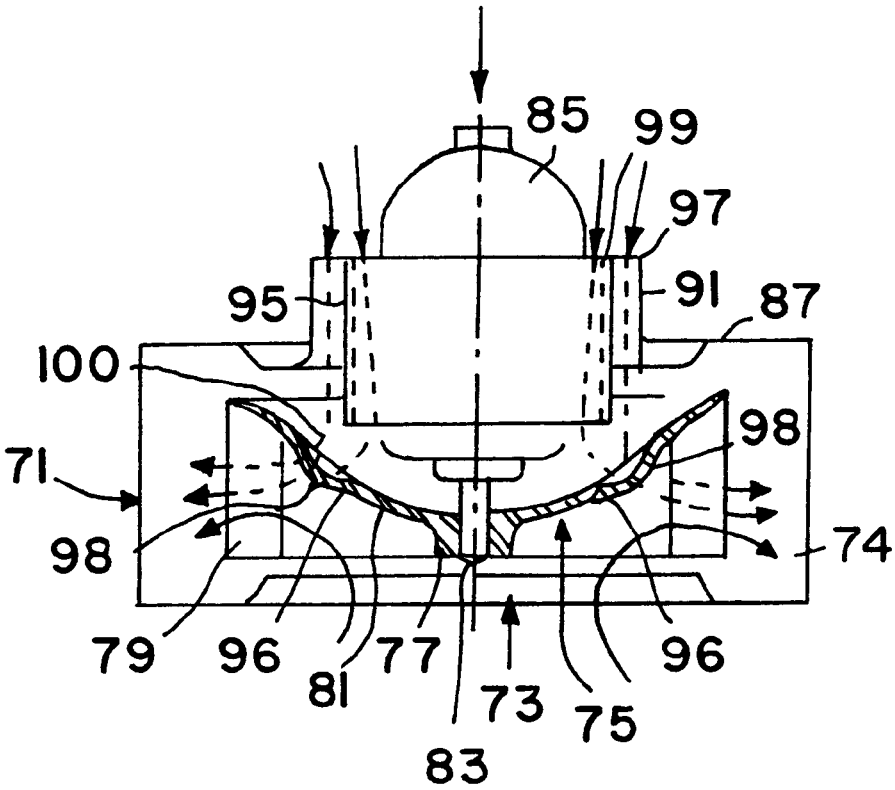
FIG. 3 shows a second embodiment of a radial blower with improved airflow channels and an added suction generating fan disk with the present hoods.
Figure 4:
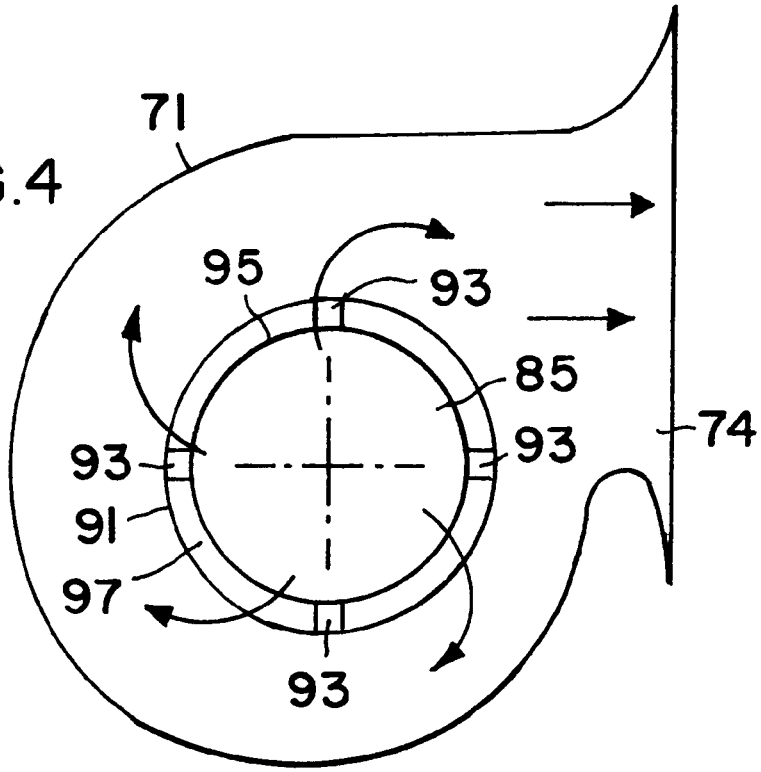
FIG. 4 shows a side view of the radial blower according to FIG. 3.

FIGS. 3 and 4 show a second example embodiment for a radial blower having a blower housing 71 comprised of two halves preferably made of plastics material. The blower housing 71 has an air intake or suction opening 73 on the front side and an air discharge or outlet 74 arranged in a plane that is circumferentially offset or displaced by 90° relative to the plane of the air intake opening 73. The blower housing 71 is formed as a spiral housing that surrounds a fan wheel 75. The fan wheel 75 has a hub 77 and a fan ring 79 which are connected to each other by a fan disk 81 substantially formed as a shell shape. The hub 77 is rigidly connected to a shaft 83 of an electric blower drive motor 85 which is supported, for example, on a rear wall 87 of the blower housing 71 whereby the fan wheel rotates with the shaft 83. Preferably, the fan wheel 75 is constructed as an injection-molded part, made of plastic material.

As can be seen in FIGS. 3 and 4, a pole ring 95 of the drive motor 85 is seated in a cylindrical extension 91 of the housing rear wall 87 by means of connector bars 93. An outwardly open air passage 97 having a defined cross-sectional flow area is arranged between the pole ring 95 and the cylindrical extension 91. Additional air gaps 99 having respective cross-sectional flow areas are arranged between the pole ring 95 and the inner portion of the motor 85, particularly the motor coils for flowing cooling air through the motor coils.

The shell shaped fan disk 81 with fan disk openings 96 is arranged between the hub 77 and the fan ring 79 so that the rotating fan ring 79 sucks air into the housing 71 through the air inlet 73 and through the air passages 97, the gaps 99 and through openings in the rear wall 87 of the blower housing 71. The cross-sectional flow areas of the air passage 97 and of the air gaps 99 determine the volume of the air flow drawn or sucked in at the rear wall 87 of the blower housing 71.

According to the invention, the fan wheel 75 with its fan disk openings 96 through the fan disk 81 is constructed in the same way as the fan wheel 19 according to FIG. 2. Accordingly, an increased flow of cooling air through the air passages 97 and through the air gaps 99 is generated by streamlined hoods 98 arranged to at least partly cover the fan disk openings 96 as described above with regard to the hoods 61 for generating a negative pressure as the fan wheel 75 rotates, thereby increasing the air flow through the drive motor 85 and into the suction side of the blower housing 71.

The radial blower according to the invention has an increased efficiency, whereby the motor is intensively cooled. The operating temperatures of the components in the drive motor are lowered to an uncritical range, even when the blower is installed in automobiles with very little space. These features achieve a longer service life of the drive motor and, thus of the radial blower.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A radial blower comprising a spiral housing, an air inlet in said spiral housing, a fan wheel in said spiral housing, a blower drive motor mounted for driving said fan wheel in said spiral housing, said fan wheel comprising a hub, fan blades forming a fan ring and a shell shaped, vaulted fan disk connecting said fan ring to said hub, said fan disk comprising at least one fan disk opening, a hood arranged on a fan disk surface facing away from said blower drive motor, said hood covering at least a forward or leading portion of said fan disk opening relative to a direction of rotation of said fan wheel for generating a negative pressure on said fan disk surface facing away from said motor when said fan wheel rotates, whereby airflow through said at least one fan disk opening and through said blower drive motor is increased.

2. The radial blower of claim 1, wherein said fan disk opening has a circular shape and is at least partially covered by said hood, said hood having a hemispheric, shell shape closed at a leading end facing in said direction of rotation, said hemispheric shell shape having an opening facing opposite said direction of rotation for generating said negative pressure thereby discharging at least part of the cooling air passing through said motor.

3. The radial blower of claim 1, wherein said blower housing (71) comprises a housing extension (91) arranged opposite said air intake opening (73) of said blower housing, and mounting lands (93) holding said blower drive motor (85) at least partly in said housing extension, and wherein said blower drive motor (85) comprises a motor housing (91) and a pole ring (95) in said housing extension (91), at least one air intake (97) between said motor pole ring (95) and said housing extension, and at least one air gap (99) between said pole ring (95) and an interior of said blower drive motor (85) for cooling motor coils inside said blower drive motor.

4. The radial blower of claim 1, wherein said blower housing (1A) comprises an outwardly closed housing extension (9), wherein said blower drive motor is mounted at least partly in said housing extension, said closed housing extension (9) forming an air guide channel (27) extending from a spiral chamber (23) in said spiral housing (1A) through said housing extension (9), wherein said blower drive motor (11) comprises a housing (55) with air inlets (29,31) opening into said air guide channel (27), said motor housing (55) further having air outlets (33) for passing air from said spiral housing (23) through said air guide channel (27) and through said 11 motor.

5. The radial blower of claim 1, wherein said fan wheel (19) of said radial blower comprises inner vanes (69) secured to a motor facing side of said fan wheel, said inner vanes (68) extending radially outwardly from said hub (15) at least to a point where said fan disk openings (43) are positioned in said fan disk (17).

6. The radial blower of claim 1, wherein said fan wheel including said hub (15), said fan disk (17), said fan wheel blades (21) and said fan ring (20) are made of a plastics material.

7. The radial blower of claim 6, wherein said fan wheel, said hub, said fan disk, said fan wheel blades and said fan ring are made as an injection molded part.

* * * * *